US011123794B2

(12) United States Patent
Desmeules et al.

(10) Patent No.: US 11,123,794 B2
(45) Date of Patent: Sep. 21, 2021

(54) SYSTEM AND METHOD FOR POURING MOLTEN METAL FROM A CRUCIBLE

(71) Applicant: Dynamic Concept, Saguenay (CA)

(72) Inventors: Jean-François Desmeules, Jonquière (CA); Jean-Benoit Néron, Jonquière (CA)

(73) Assignee: DYNAMIC CONCEPT, Saguenay (CA)

( * ) Notice: Subject to any disclaimer, the term of this patent is extended or adjusted under 35 U.S.C. 154(b) by 0 days.

(21) Appl. No.: 16/467,907

(22) PCT Filed: Dec. 7, 2017

(86) PCT No.: PCT/CA2017/051483

§ 371 (c)(1),
(2) Date: Jun. 7, 2019

(87) PCT Pub. No.: WO2018/102927

PCT Pub. Date: Jun. 14, 2018

(65) Prior Publication Data

US 2020/0101529 A1 Apr. 2, 2020

Related U.S. Application Data

(60) Provisional application No. 62/431,705, filed on Dec. 8, 2016.

(51) Int. Cl.
*B22D 35/04* (2006.01)
*B22D 39/04* (2006.01)

(52) U.S. Cl.
CPC ..... *B22D 35/04* (2013.01); *B22D 39/04* (2013.01)

(58) Field of Classification Search
CPC ..... B22D 35/04; B22D 39/04; B22D 41/00; B22D 41/04; B22D 41/06; B22D 41/08; B22D 41/50
See application file for complete search history.

(56) References Cited

U.S. PATENT DOCUMENTS 2,224,805 A * 12/1940 York ..... B22D 45/00 294/16
3,818,971 A * 6/1974 Schutz ..... B22D 39/04 164/457

(Continued)

FOREIGN PATENT DOCUMENTS

CN 201592243 9/2010
DE 2708632 8/1978

(Continued)

OTHER PUBLICATIONS

Olivier Porte, European Search Report EP17877633.2, dated Apr. 2, 2020, 61 pages.

(Continued)

*Primary Examiner* — Kevin P Kerns
*Assistant Examiner* — Steven S Ha
(74) *Attorney, Agent, or Firm* — Benoit & Cote Inc.; Mathieu Audet; C. Marc Benoit

(57) ABSTRACT

A system for feeding molten metal provided by a feeding component to a receiving component. The system comprises a launder circuit having an upstream end and a downstream end and a flow path fluidly connecting the upstream end to the downstream end, wherein the feeding component feeds the launder circuit with molten metal at the upstream end and the launder circuit feeds molten metal to the receiving component at the downstream end. The system also comprises a feed tilting mechanism located at the upstream end for tilting the feeding component between a holding angle for holding molten metal in the feeding component and a feeding angle for feeding molten metal to the launder circuit, a feeding scale for measuring weight of molten metal contained in the feeding component and generating weight signals accordingly; and a controller.

18 Claims, 9 Drawing Sheets

(56) References Cited

U.S. PATENT DOCUMENTS

| | | | | |
|---|---|---|---|---|
| 3,833,048 | A | 9/1974 | Kreuz et al. | |
| 4,049,249 | A * | 9/1977 | Moser | C21C 5/50 266/247 |
| 4,084,631 | A * | 4/1978 | Kunzmann | B22D 39/04 164/155.2 |
| 5,398,750 | A | 3/1995 | Crepeau et al. | |
| 6,425,505 | B1 * | 7/2002 | Heaslip | B22D 41/50 164/437 |
| 2004/0221981 | A1 | 11/2004 | Beale et al. | |
| 2005/0126739 | A1 | 6/2005 | Willems et al. | |
| 2008/0196856 | A1 | 8/2008 | Terrada et al. | |

FOREIGN PATENT DOCUMENTS

| | | |
|---|---|---|
| DE | 3007347 | 9/1981 |
| WO | 9706060 | 2/1997 |
| WO | 2005095027 | 10/2005 |
| WO | 2016158055 | 10/2016 |

OTHER PUBLICATIONS

Mamputu, Patrick, International Search Report of PCT/CA2017/051483 dated Mar. 1, 2018, 4 pages.

* cited by examiner

312

SYSTEM AND METHOD FOR POURING MOLTEN METAL FROM A CRUCIBLE

CROSS-REFERENCE TO RELATED APPLICATION

This application claims priority from U.S. patent provisional application 62/431,705 entitled SYSTEM AND METHOD FOR FEEDING A SOW CARROUSEL WITH MOLTEN METAL and filed Dec. 8, 2016, the specification of which is hereby incorporated herein by reference in its entirety.

BACKGROUND

(a) Field

The subject matter disclosed generally relates to systems and methods for pouring molten metal from a crucible. More particularly, the subject matter disclosed relates to systems and methods of feeding molten metal to sow moulds.

(b) Related Prior Art

Nowadays, the solutions used to cast sows of metal involve a series of steps usually performed in two distinct environments: a smelter and a casting facility. Typically, the process involves crucibles containing molten metal to be transported by trucks from one location to the other. The handling of the crucibles within the smelter in the casting facility is performed using high capacity overhead cranes which handle crucibles which typically are used to transport about five (5) to twelve (12) tons of molten metal.

In the casting facility, crucibles of molten metal are typically tipped in order to pour the molten metal into sow moulds. That process requires a series of hydraulic components able to tip the heavy charge of the crucible. That process does not typically provide the desired result of precisely controlling the weight of the resulting sows.

Another solution involves pouring molten metal into a mobile launder used to pour the molten metal into the sow moulds. As discussed above, that process does not typically provide the desired result of precise weight control of the resulting sows.

There is therefore a need for improvements in the field of casting sows that would overcome some of the drawbacks of the existing solutions.

SUMMARY

According to an embodiment, there is disclosed a system for feeding molten metal provided by a feeding component to a receiving component, the system comprising:

a launder circuit having an upstream end and a downstream end and a flow path fluidly connecting the upstream end to the downstream end, wherein the feeding component feeds the launder circuit with molten metal at the upstream end and the launder circuit feeds molten metal to the receiving component at the downstream end;

a feed tilting mechanism located at the upstream end for tilting the feeding component between a holding angle for holding molten metal in the feeding component and a feeding angle for feeding molten metal to the launder circuit;

a feeding scale for measuring weight of molten metal contained in the feeding component and generating weight signals indicative of a measured weight of molten metal in the feeding component; and a controller operatively connected to the feed tilting mechanism and to the feeding scale for controlling a feeding of molten metal to the launder circuit based on the weight signals received from the feeding scale.

According to an aspect, the system further comprises:

a pouring launder for containing molten metal along the flow path;

a pouring launder scale for measuring weight of molten metal contained in the pouring launder and generating weight signals indicative of a measured weight of molten metal in the pouring launder; and a launder tilting mechanism for controlling operating positions of the pouring launder, wherein the operating positions comprise a holding position wherein molten metal is held in the pouring launder and a feeding position wherein molten metal is fed downstream out of the pouring launder; wherein the controller is connected operatively to the launder tilting mechanism to control operating positions of the launder tilting mechanism based on weight signals from the pouring launder scale.

According to an aspect, the launder tilting mechanism comprises a hydraulic cylinder for tilting the pouring launder between a holding position in which the pouring launder is in the holding position and a feeding position in which the pouring launder is in the feeding position.

According to an aspect, the pouring launder comprises a pouring spout fluidly connecting the flow path with the receiving component.

According to an aspect, the pouring launder comprises a lug extending inwardly in the pouring spout, wherein the lug alters flow of molten metal in the pouring spout.

According to an aspect, the launder circuit comprises inlet channels and an outlet channel, wherein each one of the inlet channels is fluidly connected to the outlet channel.

According to an aspect, the system comprises the receiving component which comprises a sow mould.

According to an aspect, the system comprises the feeding component which comprises a crucible assembly.

According to an aspect, the molten metal is provided by a plurality of feeding components and wherein the feed tilting mechanism comprises a plurality of feed tilting mechanisms, each one of the feed tilting mechanisms is associated to one of the plurality of feeding components, and wherein the controller coordinates handling of each one of the plurality of feed tilting mechanisms for controlling a feeding of molten metal to the launder circuit.

According to an embodiment, there is disclosed a system for feeding molten metal provided by a feeding component to a receiving component, the system comprising:

a launder circuit having an upstream end and a downstream end and a flow path fluidly connecting the upstream end to the downstream end, wherein the feeding component feeds the launder circuit with molten metal at the upstream end and the launder circuit feeds molten metal to the receiving component at the downstream end;

a pouring launder for containing molten metal, the pouring launder being located on the flow path between the upstream end and the downstream end;

a pouring launder scale for measuring weight of molten metal contained in the pouring launder and generating weight signals indicative of a measured weight of molten metal in the pouring launder;

a launder tilting mechanism for controlling the pouring launder to operate in a holding position for holding molten metal in the pouring launder and in a feeding position for feeding molten metal downstream out of the pouring launder; and a controller, wherein the controller is operatively connected to the launder tilting mechanism and to the pouring launder scale for controlling operating positions of the launder tilting mechanism based on weight signals received from the pouring launder scale.

According to an aspect, the system further comprises:

a feed tilting mechanism located at the upstream end of the launder circuit for tilting the feeding component between a holding angle for holding molten metal in the feeding component and a feeding angle for feeding molten metal to the launder circuit; and a feeding scale mounted for measuring weight of molten metal contained in the feeding component and generating weight signals indicative of a measured weight of molten metal in the feeding component, wherein the controller is further connected operatively to the feed tilting mechanism for controlling a feeding of molten metal to the launder circuit based on weight signals received from the feeding scale.

According to an aspect, the molten metal is provided by a plurality of feeding components and wherein the feed tilting mechanism comprises a plurality of feed tilting mechanisms, each one of the feed tilting mechanisms is associated to one of the plurality of feeding components, and wherein the controller coordinates handling of each one of the plurality of feed tilting mechanisms for controlling a feeding of molten metal to the launder circuit.

According to an aspect, the pouring launder has a longitudinal axis, two extremities according to the longitudinal axis, and a pivot axis located between the two extremities.

According to an aspect, the launder tilting mechanism comprises a hydraulic cylinder joined to the pouring launder and distant from the pivot axis.

According to an aspect, the system comprises the receiving component which comprises a sow mould.

According to an aspect, the system comprises the feeding component which comprises a crucible assembly.

According to an aspect, the launder circuit comprises inlet channels and an outlet channel, wherein each one of the inlet channels is fluidly connected to the outlet channel.

According to an aspect, the launder circuit comprises a connection connecting at least one of the inlet channels to the outlet channel, with the pouring launder being located downstream to the connection.

According to an aspect, the pouring launder comprises a pouring spout fluidly connecting the flow path with the receiving component.

According to an aspect, the pouring spout comprises a lug extending inwardly in the pouring spout, wherein the lug alters flow of molten metal in the pouring spout.

According to an embodiment, there is disclosed a molten metal pouring system for feeding molten metal provided by a feeding component to a receiving component, the molten metal pouring system comprising:

a pouring launder fed with molten metal by the feeding component and feeding molten metal to the receiving component, the pouring launder comprises a floor portion and a pouring spout which extends downwardly from the floor portion;

a pouring launder scale for measuring weight of the molten metal in the pouring launder; and a launder tilting mechanism for tilting the pouring launder between a holding angle for holding molten metal in the pouring launder and a feeding angle for feeding molten metal to the receiving component, wherein the launder tilting mechanism sets the pouring launder in one of the holding angle and the feeding angle based on a measurement by the pouring launder scale of the weight of the molten metal in the pouring launder.

According to an aspect, the floor portion is substantially flat.

According to an aspect, the pouring spout extends substantially perpendicularly from a flat part of the floor portion.

According to an aspect, the pouring spout comprises a lug extending inwardly in the pouring spout, wherein the lug alters flow of molten metal in the pouring spout.

According to an aspect, the pouring spout comprises two lugs extending inwardly in the pouring spout, wherein the two lugs alter flow of molten metal in the pouring spout.

According to an aspect, the pouring launder has a longitudinal axis, two extremities according to the longitudinal axis and a pivot axis located between the two extremities.

According to an aspect, the launder tilting mechanism comprises a hydraulic cylinder joined to the pouring launder and distant from the pivot axis.

According to an embodiment, there is disclosed a tilting table mounted to a structure fluidly connecting the tilting table to a sow carrousel, wherein the tilting table is adapted to receive a crucible assembly, the tilting table comprising:

an L-shaped body defining a vertical portion and a horizontal portion;

a pivot axis along the vertical portion, the pivot axis about which the L-shaped body is adapted to be mounted to the structure;

a feed tilting mechanism for tilting controllingly the L-shape body about the pivot axis; and a fork-like structure along the horizontal portion, the fork-like structure comprises a first fork arm and a second fork arm movable toward each other to handle and to hold the crucible assembly, wherein the tilting table is adapted when rotating about the pivot axis to pour molten metal from the crucible assembly onto the structure so that the molten metal flows into the sow carrousel.

According to an aspect, the tilting table further comprises hydraulic cylinder and wherein at least one of the first fork arm and the second fork arm is mobile under control of the hydraulic cylinder.

According to an aspect, tilting table further comprises:

a feeding scale for measuring weight of molten metal contained in the crucible assembly and generating weight signals indicative of a measured weight of molten metal in the crucible assembly; and a controller operatively connected to the feed tilting mechanism and to the feeding scale for controlling a feeding of molten metal to a launder circuit based on the weight signals received from the feeding scale.

Accordingly, in relation with the above aspects, all of the different components or characteristics of the embodiments aim to control the flow of molten metal from a feeding component, i.e. a crucible assembly, to a receiving component, i.e. a sow carrousel, such that the quantity and quality of cast sows are improved over the prior art.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
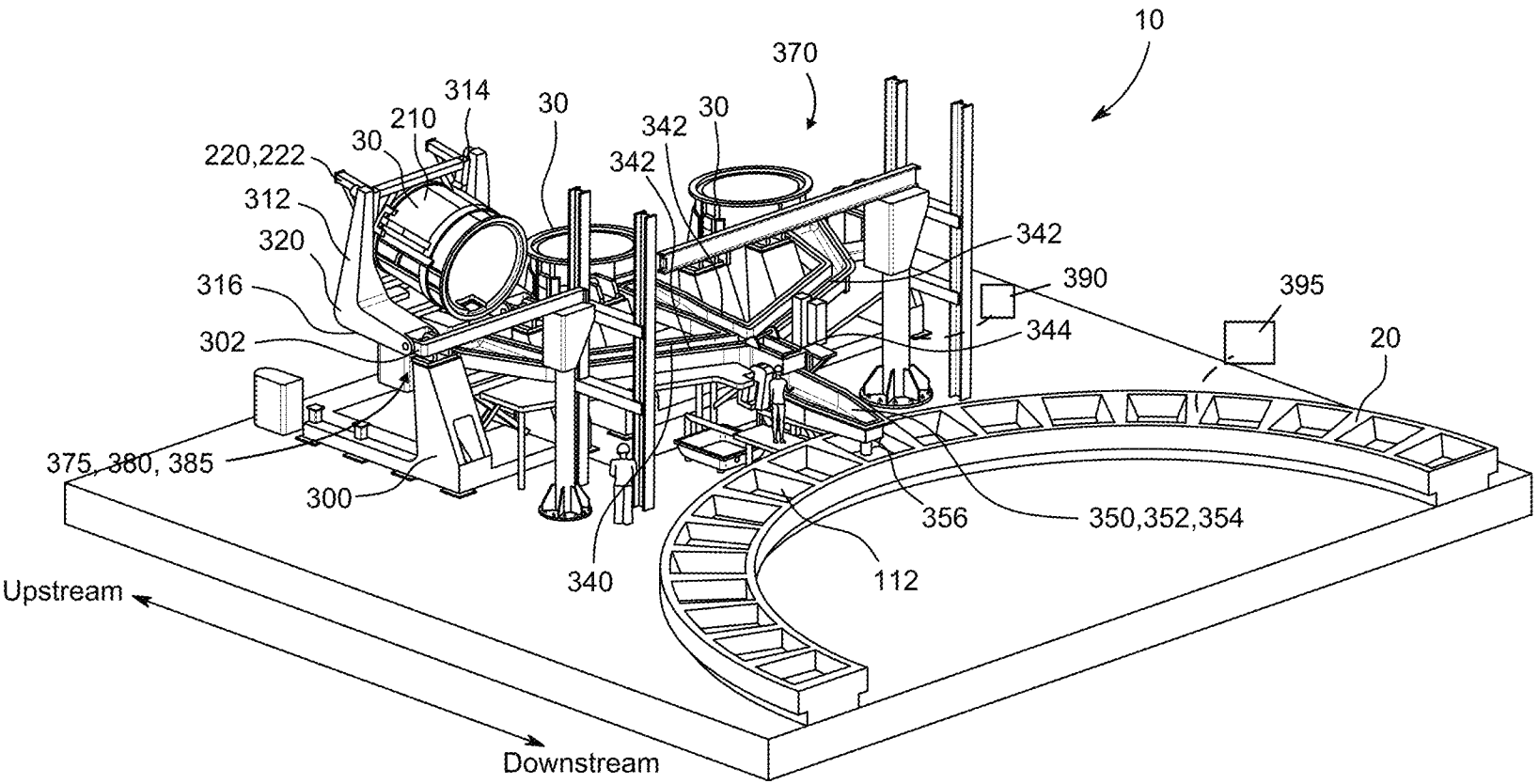
FIG. 1 is a left partial perspective view of the system for feeding a sow carrousel with molten metal in accordance with an embodiment.

Referring now to the drawings, and more particularly to FIGS. 1 to 3 and 6, there is shown a system 10 for feeding molten metal to a sow carrousel 20 that overcomes the necessity of using high capacity overhead cranes in the casting facility to handle crucibles arriving by truck from a foundry. The system 10 has the advantages over the existing solutions of accelerating the process by optionally avoiding the use of high capacity overhead cranes to handle the crucibles and by providing a more precise control over the weight of molten metal poured into the sow moulds and thereby providing more precise control of the weight of the sows.

According to another embodiment, the system 10 has the advantage, regardless of the devices and method used to feed the system 10 with molten metal, to accept a plurality of parallel feedings while providing a precise control of the weight of the sows.

The casting facility typically features a sow carrousel 20 consisting in a circular structure comprising a plurality of receiving components, namely, sow moulds 112, disposed side by side. The sow carrousel 20 is mobile and able to perform a rotation, typically a full rotation, during which the sow will be cooled down, using either an air-based cooling system or a water-based cooling system, and removed from the sow mould 112. Accordingly, during a full cycle, a sow mould 112 is filled with molten metal at a casting location, moved out of the casting location, with the sow being cooled down along the rotation of the sow carrousel 20 and removed from the sow mould 112 before the sow mould 112 returns to the casting location.

The system 10 for feeding a sow carrousel with molten metal is adapted to handle feeding components containing molten metal, namely crucible assemblies 30 (aka crucibles), delivered by trucks or alternatively by automatic guided vehicles (AGVs) and other automated transportation means. According to an embodiment, the crucible assemblies 30 transported by trucks comprise a container 210 and a support portion 220. The support portion 220 comprises a series of legs 222, i.e. four (4) legs 222, capable of supporting the crucible assembly 30 in an elevated and stable position above the ground. The container 210 defines an enclosing space above the ground with an open top where molten metal is temporarily stored for its transportation from the foundry to the casting facility.

According to an embodiment, the system 10 is able to handle independently three (3) crucible assemblies 30. Accordingly, a crucible assembly 30 may be delivered to the system 10, one used by the system 10 and one picked up by a truck from the system 10 simultaneously and independently. The system 10 comprises, in the delivery portion, delivery control components for controlling the sequence of events which are part of the delivery and the pickup actions. The delivery control components comprise set of light towers disposed in vicinity of the delivery locations of the crucible assemblies 30 and providing light signals (direction arrow lights, green lights, red lights, etc.) informing the driver of a delivery truck on the state (delivery authorized, busy or pick up authorized) of a delivery location.

According to an embodiment, a location detection system embodied as a series of lasers detecting the precise location of a delivery truck is connected operationally to light towers to guide the driver in the exact location to unload a crucible assembly 30.

The delivery control components comprise a detection coil or another type of detection system able to detect the presence of a delivery truck in the vicinity or in the delivery location. The detection system is connected to a controller 390 that, for security reasons, activates some processes and locks some functions when a truck is detected out of normal circumstances.

According to an embodiment, the delivery control components comprise a human presence detection system connected to the controller 390. The controller 390 activates a security light curtain for blocking any moving component.

The system 10 further comprises security components that a person located beside the system 10 must manually activate to reactivate the system 10 after the controller 390 enters in a fault condition. Another security component allows a person close to the system to manually activate a shut-down process resulting in a crucible currently in a pouring process to be tilted back in a vertical position (if needed) and moved down. The shut-down process further releases the grabbing components from grabbing the crucible assembly 30 thereby releasing the crucible assembly 30. Thus, the crucible assembly 30 and the system 10 returns in a default initial condition.

Still referring to FIG. 1, the system 10 comprises a structure 300. The structure 300, at an upstream end, comprises a feed tilting mechanism embodied as tilting tables 320 adapted to receive one or more crucible assemblies 30, i.e., three (3) crucibles disposed side by side, to handle the crucible assemblies 30 delivered by trucks, to empty the crucible assemblies 30 from their content of molten metal and to place the empty crucible assemblies 30 in a pick-up condition in which the crucible assemblies 30 will be ready to be picked up by trucks.

Each of the tilting tables 320 are pivotally mounted to the structure 300. The tilting tables 320 are of a substantially L-shape, pivotally mounted at the top end of the L-shape, and defining at a lower portion a fork-like structure. The fork-like structure comprises a first fork arm 312 and a second fork arm 314, under control of a fork control mechanism 385 (FIG. 4), adapted to handle and hold crucible assemblies 30, and a table body 316. The tilting tables 320, when in a feeding position, are disposed such that the fork-like structure defined by the horizontal portion of the L-Shape is in a substantially horizontal position. The fork-like structure further defines a space between the fork arms 312, 314 wherein a truck may backup to deliver a crucible assembly 30. At least one of the fork arms 312, 314 is mobile, driven by hydraulic cylinders, and able to move toward and away from the other fork arm 312, 314 so that a crucible assembly 30 disposed between the fork arms 312, 314 can be firmly gripped and held by the fork arms 312, 314 once the delivery truck has driven away from the structure 300.

According to an embodiment, four (4) hydraulic cylinders drive the fork arms 312, 314 during the process of gripping the crucible assembly 30. Detectors are mounted on the fork arms 312, 314 to detect whether or not the crucible assembly 30 is gripped adequately. The detectors are mounted in a serial manner with a cable. In this configuration, a single one of the detectors failing to provide the right signal prevents the continuation of the process.

Figure 2:
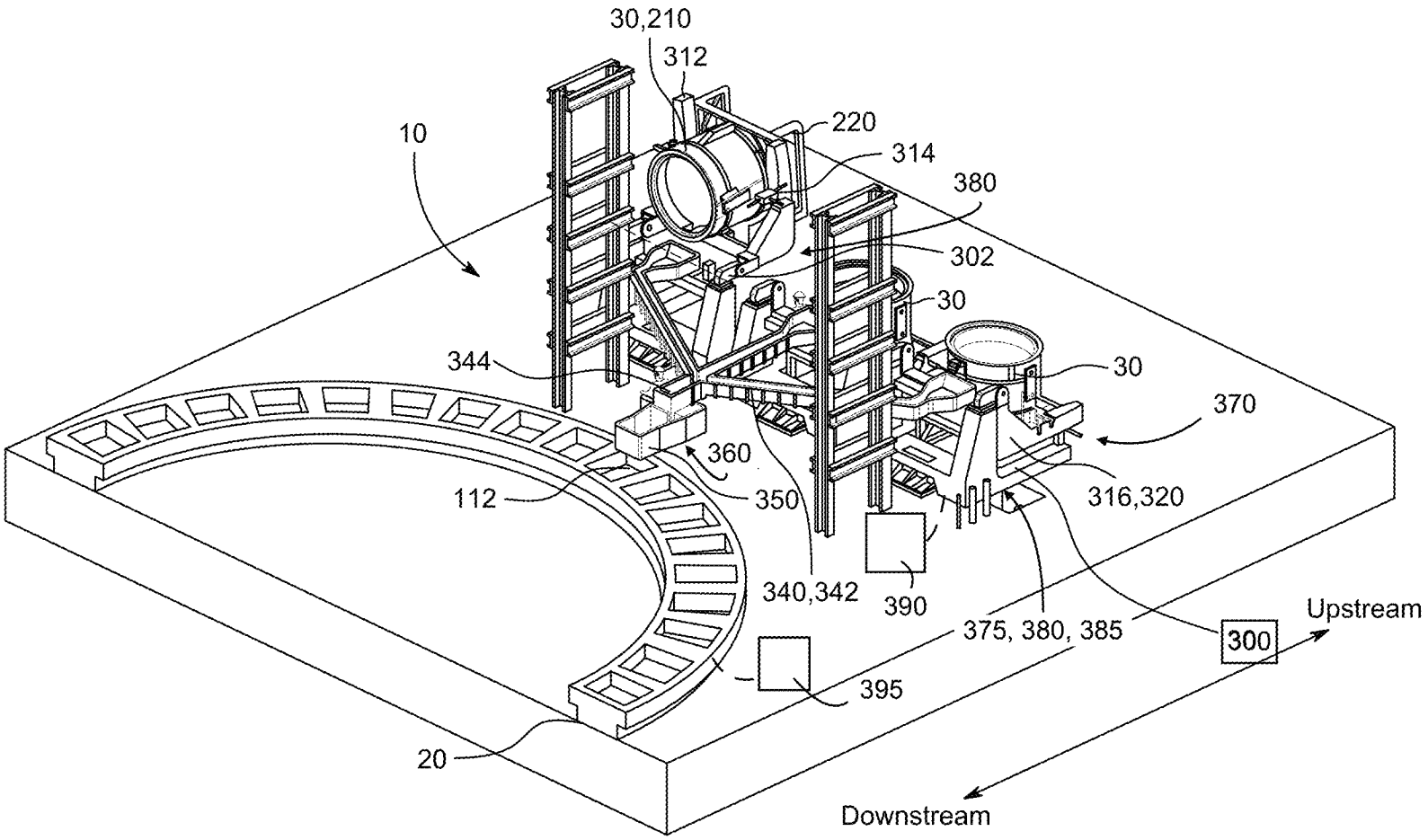
FIG. 2 is a right partial perspective view of the system for feeding a sow carrousel with molten metal in accordance with an embodiment.
Figure 3:
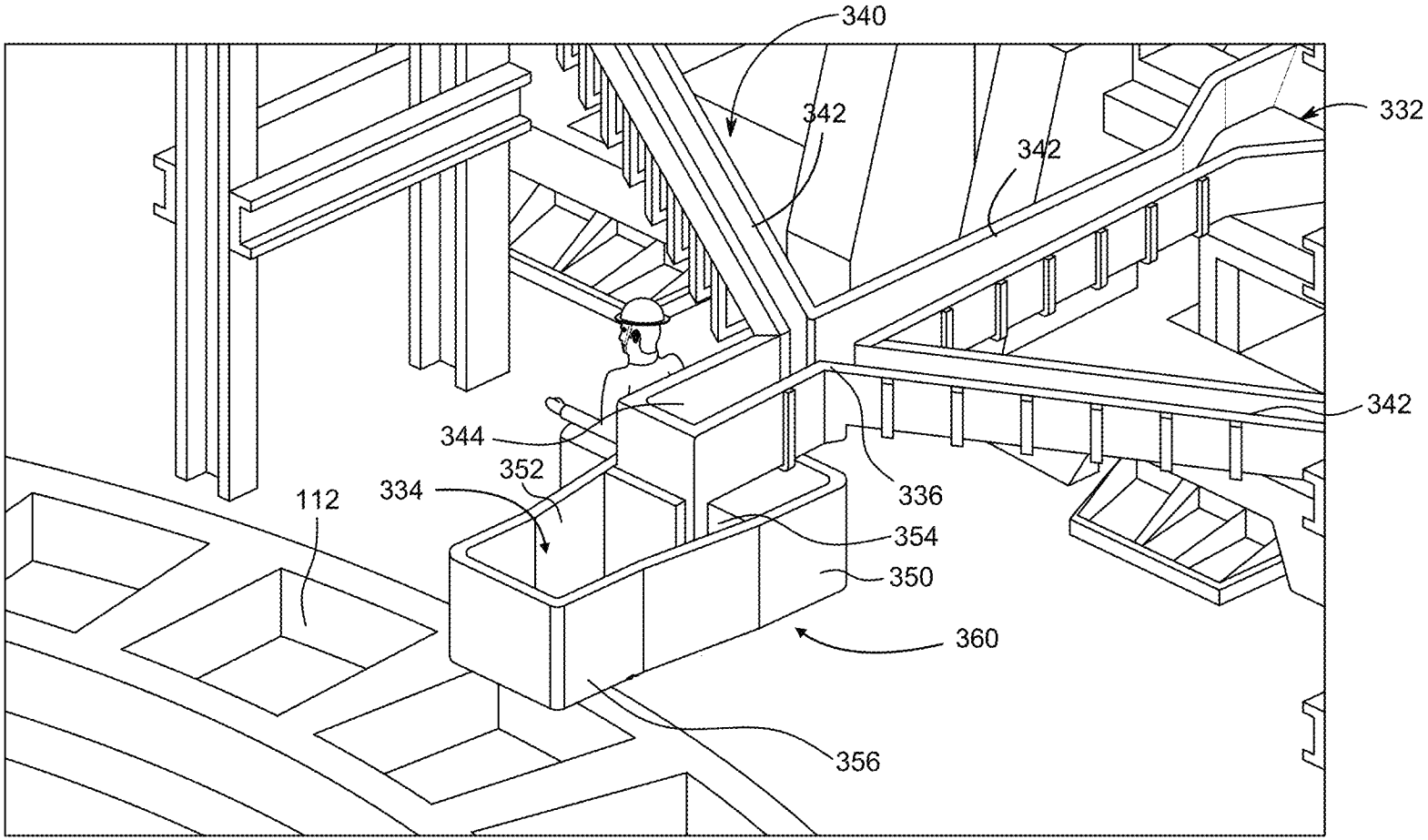
FIG. 3 close-up partial perspective view of some of the components of the system for feeding a sow carrousel with molten metal according to an embodiment.
Figure 4:
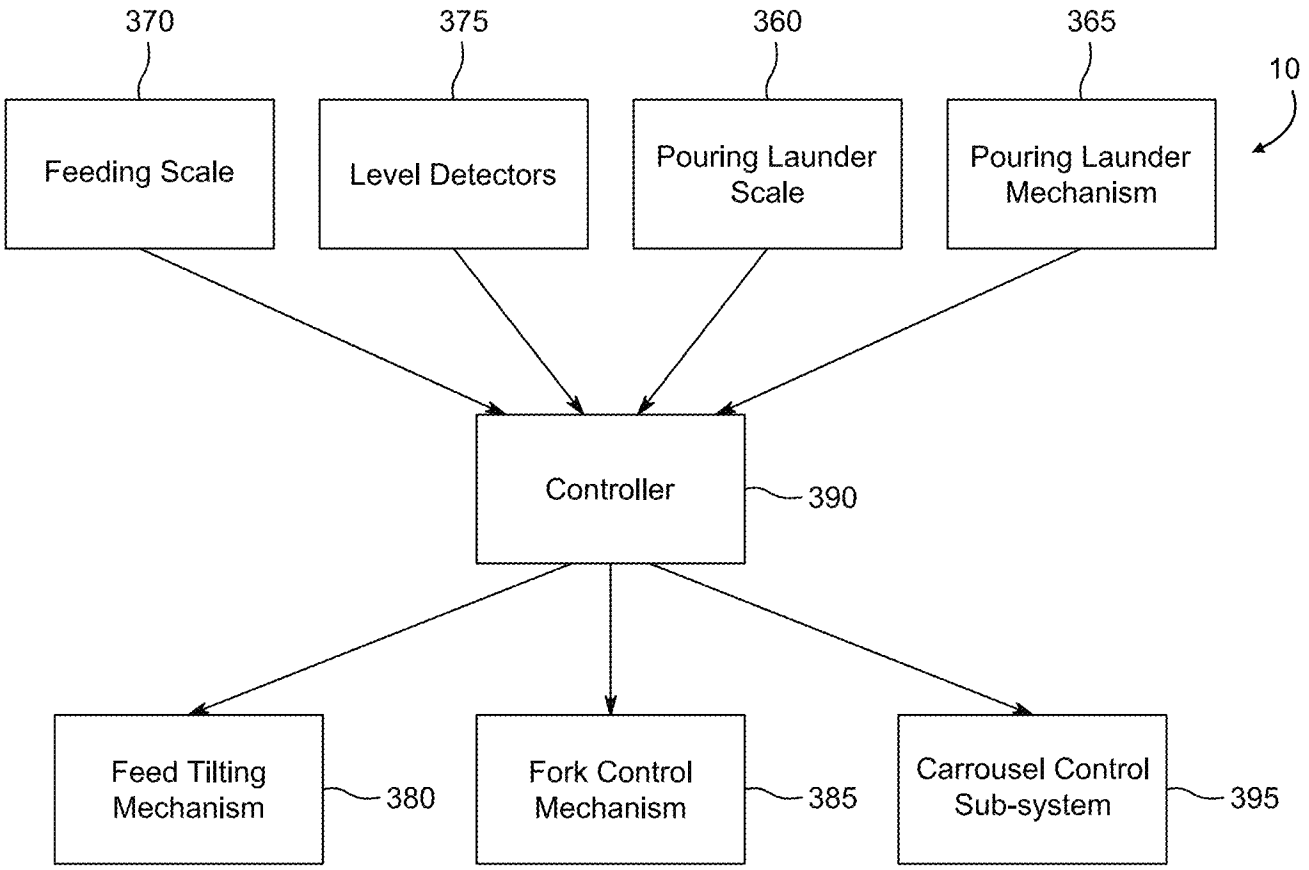
FIG. 4 is a schematic illustration showing the control components of the system for feeding a sow carrousel in according with an embodiment.

Two (2) lock arms 317 (FIGS. 6 to 8), driven by hydraulic cylinders (not shown), are for locking the crucible assembly 30 in place between the fork arms 312, 314 once the fork arms 312, 314 are gripping the crucible assembly 30. The lock arms are distant from the table body 316, and define, in combination with the table body 316 and the fork arms 312, 314, a semi-enclosed perimeter (defining a passage 315) from which the crucible cannot move out without the lock arms and the fork arms 312, 314 moving away from the crucible assembly 30. Pressure detectors are mounted on the lock arms and connected to the controller 390 (FIG. 2 and FIG. 4).

Each of the tilting tables 320 are further driven by additional hydraulic cylinders to rotate over about ninety degrees (90°) around their pivot axis 302 in order to pour the molten metal contained in the crucible assemblies 30 into a launder circuit 340. The tilting tables 320 are for controllably pouring the molten metal by precisely controlling the angle of the tilting table 320, thus of the crucible assembly 30, during the pouring process. The angle is determined by the controller 390 based on a continuous monitoring of the weight of the crucible, or in other words as a function of the weight decrease rate of the crucible during the process according to the angle of the tilting table 320 at the time. The fork arms 312, 314 remain in a holding position during the pouring process, keeping a tight grip on the crucible assembly 30 during the whole process.

According to an embodiment, the forks arms 312, 314 comprises alternative components to grab the crucible assemblies 30, to hold them and to lift them up securely. Furthermore, the forks arms 312, 314 are motorized with a different number and combination of hydraulic cylinders to perform the grabbing, holding/securing, lifting and tilting processes.

The fault monitoring system comprise detectors adapted to monitor the operation as to detect malfunction of any of the grabbing, holding, securing, lifting and tilting processes comprises a combination of at least some of contact detectors, position detectors, distance detectors, pressure detectors, scale, heat detectors, solenoids, and cameras. Some of the monitoring components are arranged in parallel, while other are arranged in series for security purpose. Furthermore, some redundancy may be provided among the monitoring components to allow a second monitoring component, of the same kind or of another kind, to trigger a malfunction if one main detector fails.

According to an embodiment shown in FIG. 2, a feeding scale 370 is mounted to each of the tilting tables 320. The feeding scale 370 is communicatively connected to the controller 390, and adapted to continually determine the weight of molten metal that is contained in the crucible assembly 30, through either the measure of the weight of the crucible assembly 30 and its content or the combination of the crucible assembly 30 (and its content) and the tilting table 320. Accordingly, the controller 390 is able to determine the rate of molten metal (e.g., in kg per second) flowing down in the launder circuit 340 and therefore the weight of molten metal poured into the sow mould 112. It therefore allows the controller 390 connected operatively to the tilting tables 320 to command the tilting tables 320 to modify their angle accordingly. Their angle can be modified from a holding angle in which a crucible assembly 30 is in position to hold its contained molten metal, to a feeding angle in which a crucible assembly 30 is in a feeding position to feed the launder circuit 340 with its contained molten metal, and various angles in between for various flows.

Once a crucible assembly 30 is emptied, i.e., when the content of molten metal has entirely been poured out of the crucible assembly 30, the tilting table 320 is tilted back from a feeding angle into a holding angle.

As discussed and shown in FIG. 1, the structure 300 has a launder circuit 340 mounted thereto (or incorporated therein), the launder circuit 340 defining a flow path fluidly connecting crucible pouring location(s) (at an upstream location) to the sow carrousel 20 (at a downstream location). The launder circuit 340, according to an embodiment, comprises a plurality of individual launder segments 342 connecting inlet channels 332, each associated with a tilting table 320, to a main launder segment 344 connected to an outlet channel 334 leading the molten metal to the sow mould 112. According to an embodiment, the individual launder segments 342 are connected to the main launder segment 344 at a single point, a connection 336 (see FIG. 3). According to another embodiment, a connection 336 connects two (2) upstream launder segments and a single downstream launder segment.

The launder circuit 340 is heated prior to the beginning of the pouring process. The pre-heating process prevents moisture to affect the casting process (moisture explosions) and prevents freezing of the metal in the launder circuit 340. According to one embodiment, the pre-heating process involves a series of gas heaters disposed under at least some segments 342, 344 of the launder circuit 340. According to one embodiment, the gas heaters are propane gas heaters and/or natural gas heaters. According to an embodiment, moisture on the launder circuit 340 is removed using electrical radiant heaters, electrical forced air heaters or gas burners.

According to an embodiment, at least some of the segments 342, 344 of the launder circuit 340 comprise level detectors 375 (FIG. 4) connected to a controller 390. If one of the level detectors 375 detects a level of molten metal over a predetermined limit level, a signal is transmitted by the level detector 375 to the controller 390 which enters in an overflow process and decreases or stops the feeding of molten metal from at least one of the crucible assembly 30 based on the location of the level detector 375.

According to an embodiment, one of the main launder segment 344 and all of the individual launder segments 342 are equipped with controllable combs (not shown) adapted to block the flow of big impurities in the molten metal. The combs are controllable to operate in collaboration with the level detectors 375 to prevent overflow and to allow drainage of the launder segments 342, 344 to ensure operative conditions of the system 10.

According to an embodiment, the launder segments 342, 344 are sloped downwardly from the individual launder segments 342 at the upstream end to the main launder segment 344 to facilitate the downstream flow of molten metal by gravity. According to an embodiment, each of the launder segments 342, 344 are individually sloped accordingly.

According to an embodiment, the launder circuit 340 comprises a pouring launder 350 for containing and feeding molten metal. The main launder segment 344 is adapted to pour molten metal into the pouring launder 350 located downstream to the connection 336, and according to one embodiment at the downstream end of the main launder segment 344. The pouring launder 350 comprises an elevated shape defining a volume container 352 capable of holding a predetermined weight of molten metal required to cast a sow, typically 1 to 2 times the weight of molten metal necessary for casting a single sow. The pouring launder 350 is mounted in association with a pouring launder scale 360 for controlling the weight of molten metal poured into a sow mould 112 by controlling the weight of molten metal received from the upstream portion of the launder circuit 340. According to an embodiment, the pouring launder scale 360 measures the weight of molten metal contained in the pouring launder 350 at all times. According to an embodiment, the pouring launder scale 360 is communicatively connected to the controller 390.

The volume container 352 of the pouring launder 350 comprises a floor portion 354 that is substantially downwardly sloped toward a pouring spout 356 (when the pouring launder 350 is tilted in the feeding position as discussed below) which is controllably closable and is located above the sow carrousel 20. Thus, by opening the pouring spout 356, the molten metal contained in the volume container 352 flows down into the sow mould 112 located below. According to an embodiment, the floor portion 354 is substantially flat and the pouring spout 356 extends downwardly from a flat part of the floor portion 354. According to an embodiment, the pouring spout 356 extends downwardly substantially at a right angle from the floor portion 354; i.e., the general direction of the pouring spout 356 is substantially perpendicular to the flat floor portion 354. Having the pouring spout 356 located in the floor portion 354 makes it much easier to control the flow of molten metal and ensures that all molten metal is emptied from the pouring launder 350. In known prior art pouring launders, the pouring spout is at an end of the pouring launder; i.e., not in a flat part of the floor, but rather at the upper end of a vertical wall which extends from the floor. Hence the pouring launder of the prior art cannot be emptied completely since some molten metal will remain where the floor and the bottom of the vertical wall meet.

According to an embodiment, the pouring spout 356 is controllable by the controller 390 in operating positions, namely a holding position wherein molten metal is held in the pouring launder 350 and a metal feeding position wherein the molten metal flows out of the pouring launder 350.

Figure 9:
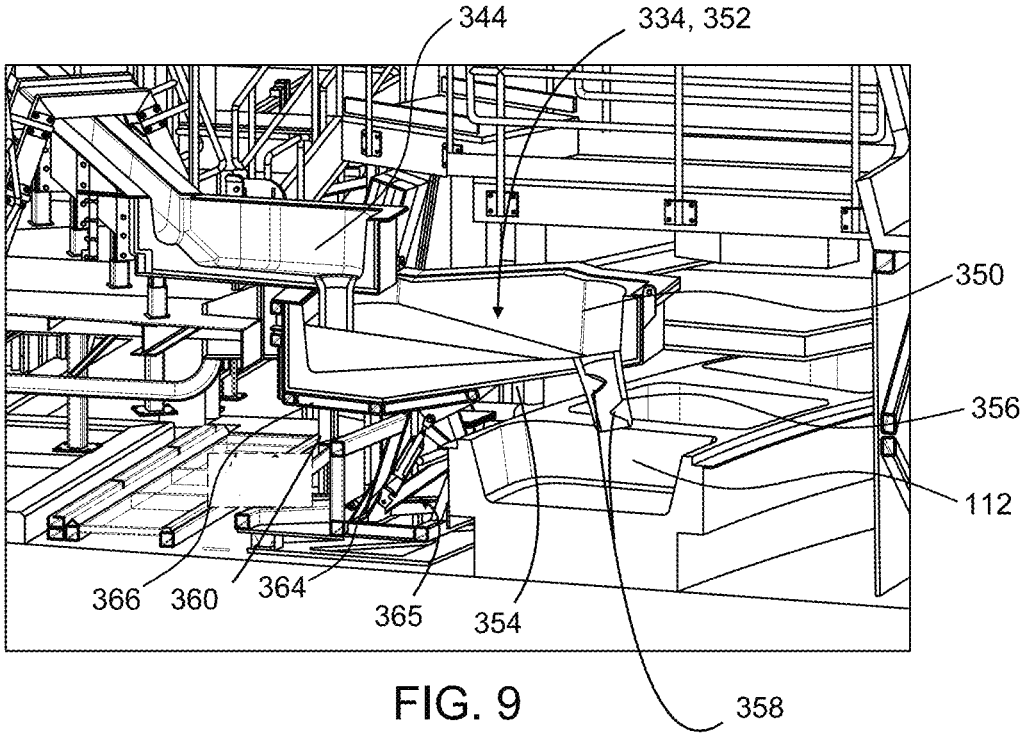
FIGS. 9 and 10 are perspective side cross-section views specifically of the launder tilting mechanism and the pouring launder in distinct operative positions in accordance with an embodiment.
Figure 10:
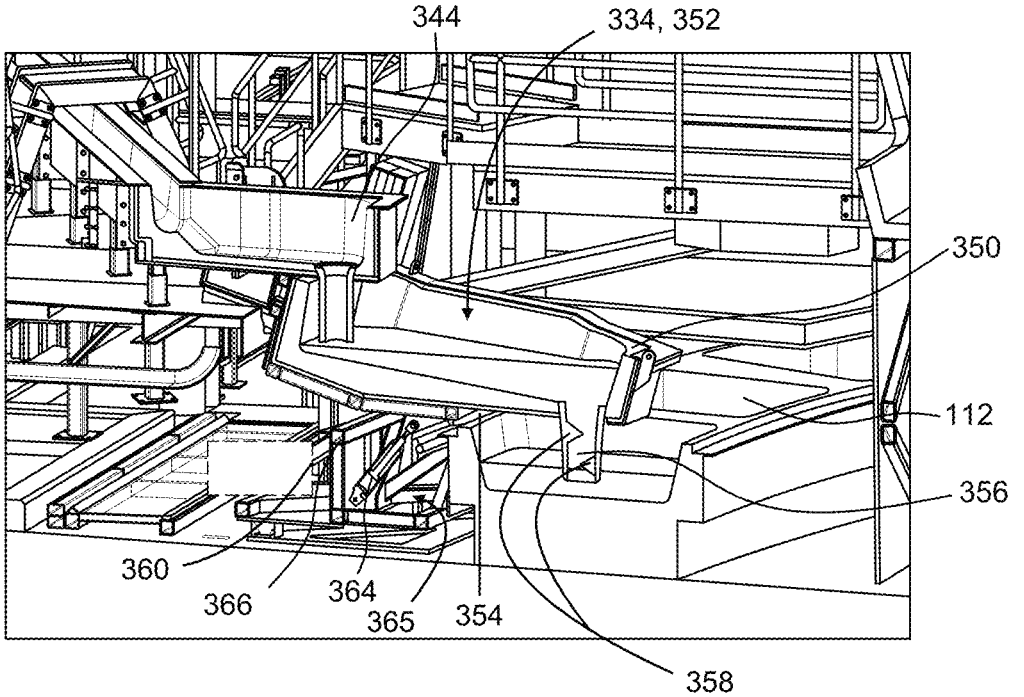

According to an embodiment illustrated on FIGS. 9 and 10, the pouring spout 356 features a series of lugs 358 extending inwardly. The lugs 358 have sloped top faces relative to the longitudinal orientation easing the downward flow of molten metal while slowing the general flow of said molten metal to prevent spilling.

According to embodiments, one or more alternative spout components comprise similar lugs to control speed of flow and prevent spilling.

According to embodiments, the size of the lugs 358, namely the height and the inward length of the lugs from the inside face of the pouring spout 356, and the distance between the lugs are configured based on operational parameters, namely the characteristics of the molten metal, the desired flow and the total length of the pouring spout 356.

According to other embodiments (not shown), alternative flow controlling means are embedded in the pouring spout 356 and/or other molten metal guiding conduits. Examples of alternative flow controlling means comprise a helical panel extending inwardly from the inside wall of the pouring spout 356 and mechanically controlled flow hindering components.

According to an embodiment, the pouring launder 350 is mounted to a pivot axis 366 and a hydraulic cylinder 364 controllable by the controller 390 to control tilting actions of the pouring launder 350 to transition between the holding position (at a holding angle) and feeding position (at a feeding angle), the latter being when molten metal pours out of the pouring launder 350 into a sow mould 112. The tilt angle of the pouring launder 350 is controlled by the controller 390 (FIG. 4) controlling a proportional control valve connected to the hydraulic cylinder driving the tilting movement of the pouring launder 350. As with the control of the flow of molten metal out of the crucible assemblies 30, the controller 390, through signals continuously transmitted by the pouring launder scale 360, controls the weight of molten metal poured in a sow mould 112.

The present system 10 is capable of pouring about 750 kg of molten metal in a controlled manner in a sow mould 112 in about 10 to 60 seconds, repeatedly or over an unrestricted period of time.

Now referring to FIGS. 9 and 10, according to another embodiment as discussed above, the controller 390 of the system 10 for pouring molten metal operates a tilting pouring launder 350 mounted to a combination of a pivot axis 366 and a hydraulic cylinder 364. The combination of a pivot axis 366 and a hydraulic cylinder 364 is for tilting the pouring launder 350 forth (FIG. 10, in a substantially horizontal position), to pour molten metal downstream, and back (FIG. 9, in a back-sloped position), to pour molten metal in the pouring launder 350. A pouring launder scale 360 measures the weight of the molten metal present in the pouring launder 350 at all times. The position of the pouring launder 350 is controlled by the controller 390 which determines when to tilt the pouring launder 350 based on measurements from the pouring launder scale 360 and commands the hydraulic cylinder.

As illustrated, the pouring launder 350 is fed with molten metal at one end by a main launder segment 344, and feeds a sow mould 112 at the other end. Alternative embodiments comprise alternative molten metal feeding systems that may feed molten metal to the pouring launder 350, and/or the pouring launder 350 may pour a precise quantity of molten metal into an alternative type of receiving component, such as a crucible. Another alternative comprises the location of the pouring launder 350 being elsewhere along the flow path, for example somewhere upstream to the illustrated location closer to the connection 336 show in FIG. 3.

According to an embodiment (not illustrated), the system 10 comprises an emergency draining bin located about the pouring launder. The emergency draining bin is adapted to receive the content of the pouring launder in case the carrousel is not ready. For example, the carrousel may not have been indexed, having the ready-to-receive-molten-metal sow mould already filled, or having no sow mold ready to receive molten metal from the pouring launder. In such conditions, with the pouring launder filled with molten metal and requiring emptying, the molten metal may be redirected to the emergency draining bin. The emergency feeding comprises the opening of a gate redirecting the molten metal toward the emergency draining bin.

Referring to FIG. 4, a schematic illustration of the control components of the system for feeding a sow carrousel is provided. It is to be noted that the direction of the arrows illustrates the data collected and transmitted as commands transmitted to operating components. The signals exchanged for diagnostic purposes and involved in communication protocols have been voluntarily omitted in order to more clearly illustrate the flow of actions from the sensing of physical conditions performed by components to the commands translated into actions performed by functional components of the system.

According to an embodiment, the controller 390 is communicatively connected to at least one of a feed tilting mechanism 380 controlling the hydraulic cylinder(s) responsible for pivoting the tilting tables 320, and a launder tilting mechanism 365 controlling the pouring spout 356 and/or the hydraulic cylinder 364 and thus responsible for operating the pouring launder between a holding position or a feeding position. The controller 390 determines if additional molten metal must be poured based on signals from at least one of the feeding scale 370, the pouring launder scale 360 and the level detectors 375.

According to an embodiment, the controller 390 is communicatively connected to the fork control mechanism 385 which control the first fork arm 312 and the second fork arm 314 (see FIGS. 1 and 2).

According to an embodiment, the controller 390 is communicatively connected to one feed tilting mechanism 380 per tilting table 320, and independently transmits command signals to each of the feed tilting mechanisms 380.

According to an embodiment, the controller 390 is communicatively connected to the sow carrousel control sub-system 395, and transmits command signals, for example indexing initiation commands, to the sow carrousel control sub-system 395 associated with the sow carrousel 20. According to an embodiment, the controller 390 is communicatively connected to a sow carrousel detection system (not shown); the controller 390 receiving and processing input signal from the sow carrousel detection system.

Figure 7:
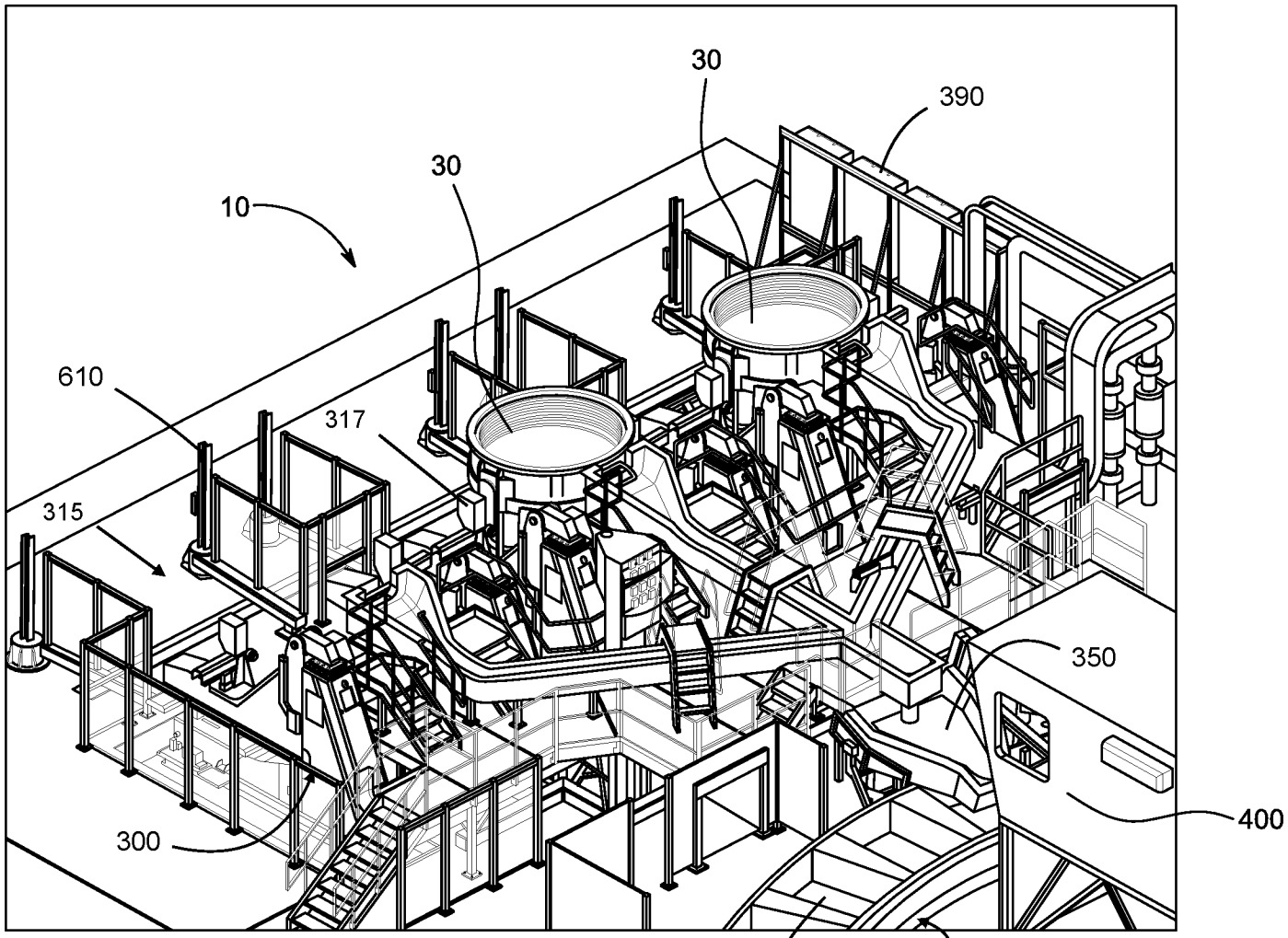
FIG. 7 is a front partial perspective view of a system for feeding a sow carrousel comprising a control center and additional environmental components in accordance with an embodiment.
Figure 8:
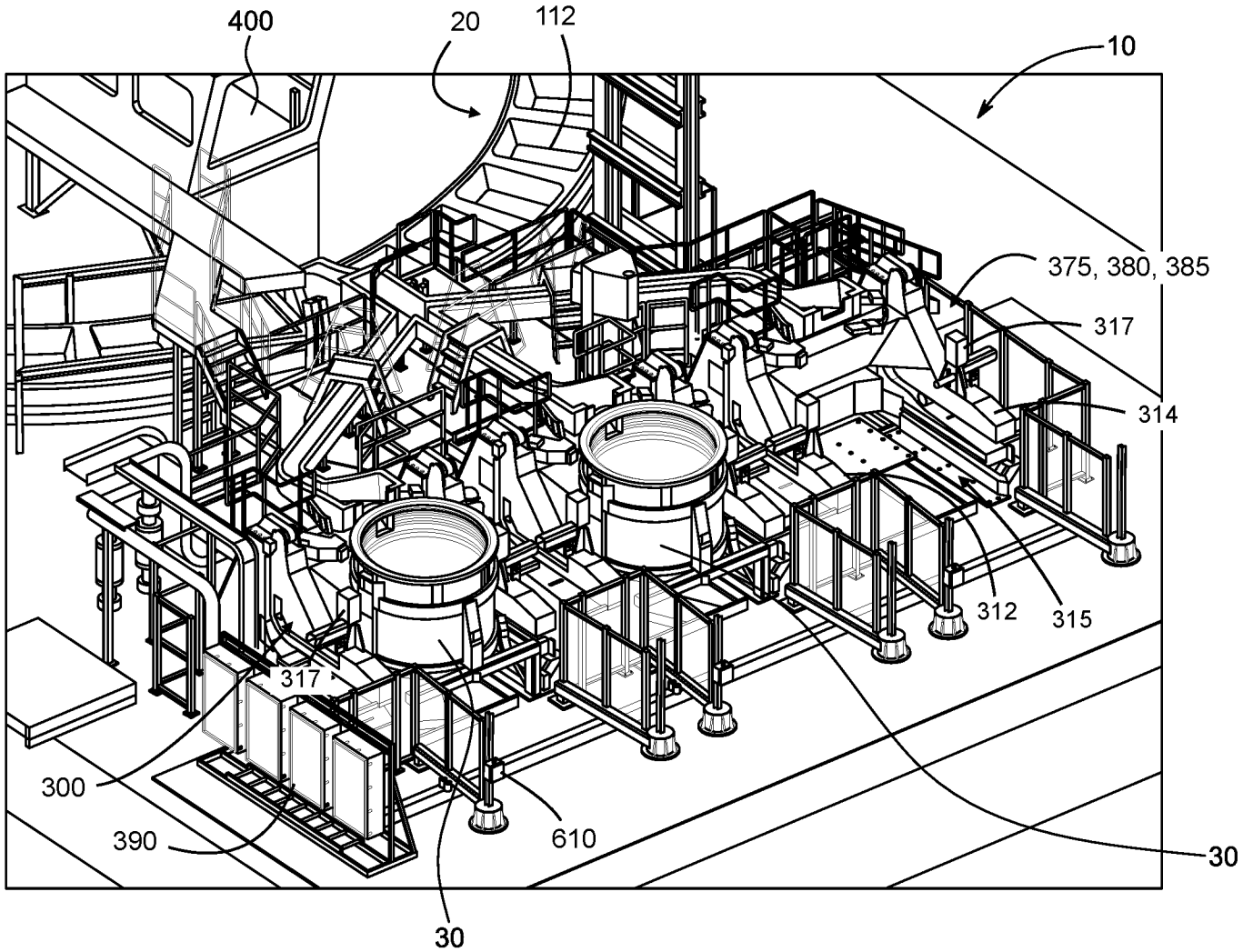
FIG. 8 is a rear partial perspective view of the system for feeding a sow carrousel shown in FIG. 7.

Now referring to FIGS. 7 and 8, a system 10 for feeding molten metal comprises a control center 400 is illustrated. FIG. 7 illustrates the embodiment through a front partial perspective view through which the launder circuit, hence the molten metal following the flow path of the launder circuit, is shown readily visible by an operator located in the control center 400. FIG. 8 illustrates the embodiment through a rear partial perspective view where the launder circuit and the crucible assemblies 30 currently in the system 10 are readily visible by an operator located on the control center 400. Footbridges are illustrated above some of the components of the system 10, for the operator to monitor more easily the operation, and access components for maintenance. One must note that additional security and environmental components discussed above, such as fences, are also illustrated.

Figure 6:
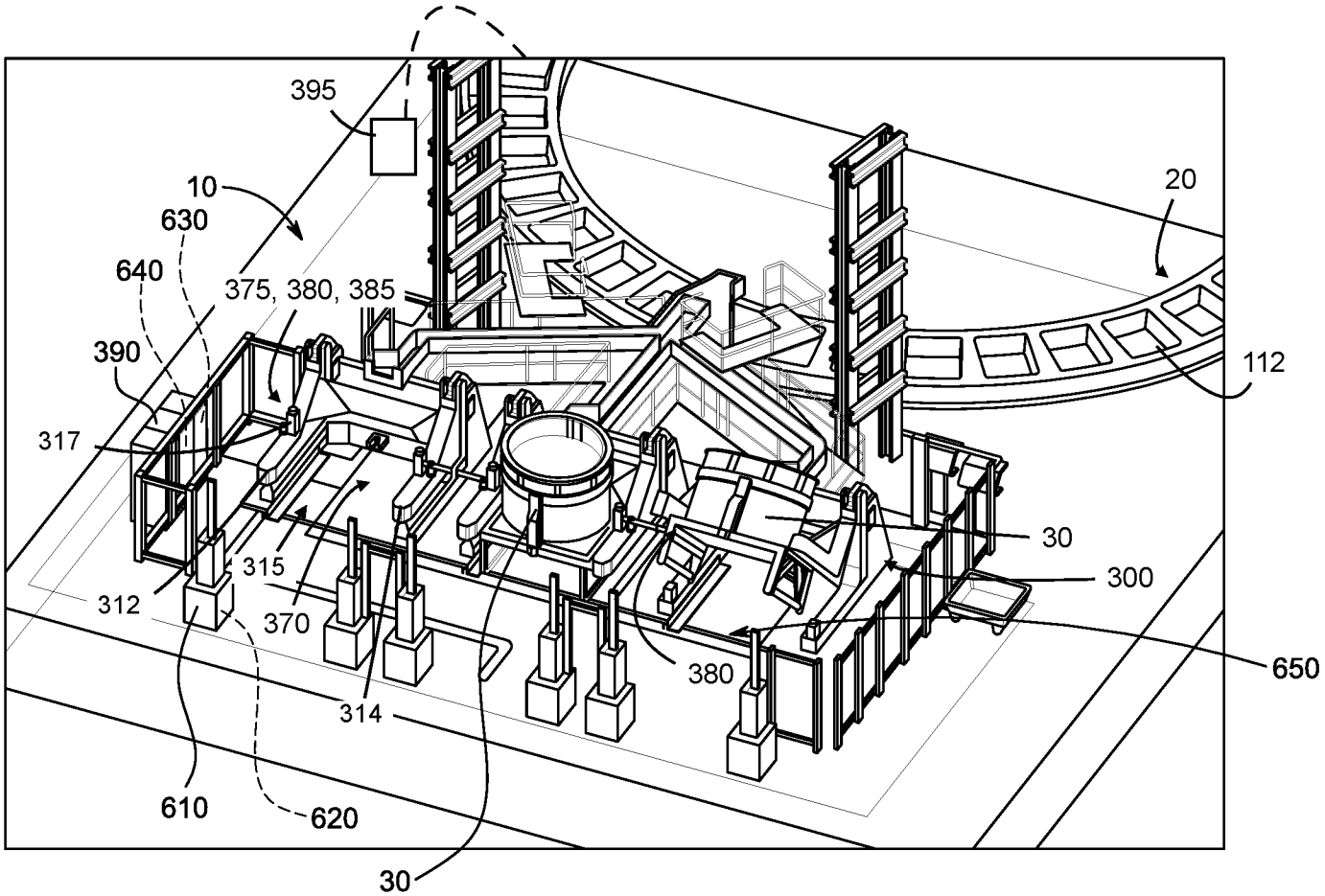
FIG. 6 is a rear partial perspective view of the system for feeding a sow carrousel with molten metal shown in FIG. 1.

FIG. 6 illustrates the system 10 from a rear partial perspective view showing components more particularly involved in the delivery of crucible assemblies 30. The controller 390 is communicatively connected to a guiding system 620 controlling guiding towers 610. Detectors 630 and sensors 640 are communicatively connected to the controller 390, transmitting signals based on conditions detected in each of the individual delivery areas 650. Detectors 630 and sensors 640 comprise, for example, optical detectors, movement detectors, weight sensors and proximity sensors.

It is worth mentioning that according to an embodiment, the components used to feed molten metal to the launder circuit may take many forms, such as the above described truck delivery solution, an automated ground-level delivery solution, and further alternatives comprising elevated delivery solutions such as overhead cranes delivering crucibles or crucible assemblies. The ground level at the upstream end and the downstream end of the system 10 may differ according to some embodiments, while keeping a slope between the upstream end and the downstream end of the system 10 to maintain natural unforced flow of molten metal in the launder circuit.

Figure 5:
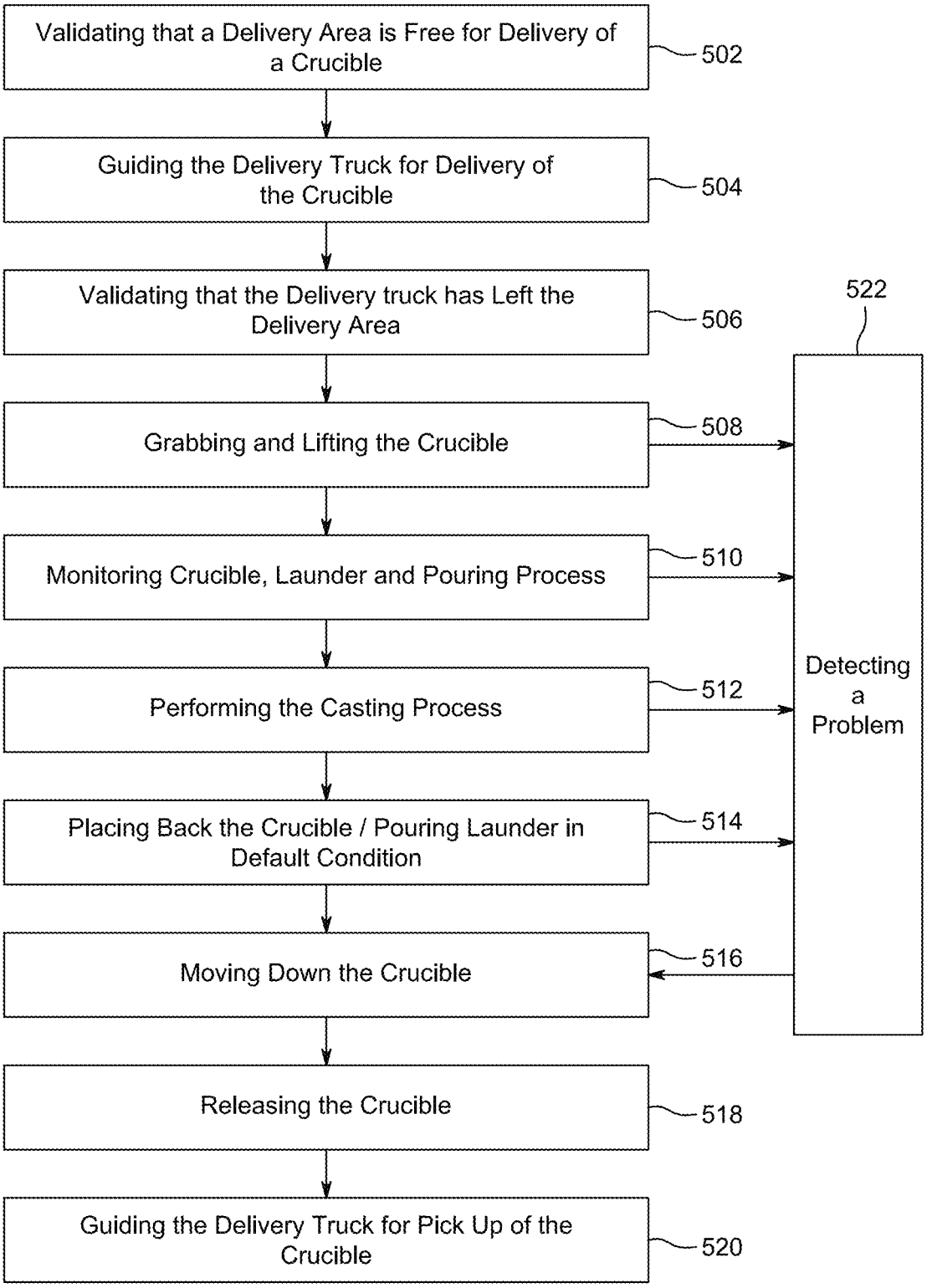
FIG. 5 is a flow chart illustrating the steps from the reception of a crucible full of molten metal from a delivery truck to the pickup of the emptied crucible from the system by a delivery truck.

Now referring to FIG. 5, a flow chart illustrates the steps from the reception of a crucible full of molten metal from a delivery truck to the pick-up of the emptied crucible from the system by a delivery truck.

The method comprises step 502 of validating that a delivery area is free for delivery of a crucible.

Step 504 comprises guiding the delivery truck during the delivery process of the crucible, comprising light signals. It further comprises guiding the truck out of the delivery area once the crucible is left in the delivery area.

Step 506 comprises validating that the delivery truck has left the delivery area, and that no person or object is in the delivery area and risks to interfere with the crucible holding process.

Step 508 comprises grabbing and lifting the crucible at the pouring height.

Step 510 comprises monitoring the pouring conditions. Before pouring any molten metal into the launder circuit, and at all times during the pouring process, the system monitors the conditions using the different detectors and scales, including the carrousel control sub-system, to control the correct realization of the pouring process.

Step 512 comprises performing the casting process. It comprises tilting, or in other words controlling the angle of the crucible to pour molten metal into the launder circuit. It also comprises controlling the pouring launder, thus at least one of controlling the pouring spout operating condition and controlling the pouring launder angle for controlling the flow of molten metal over the whole system, including the casting of molten metal in a sow mould at the downstream end.

Step 514 comprises, when the crucible is detected as being empty, tilting back the tilting table and therefore the crucible in the vertical position. This step may also comprise operating the pouring launder to interrupt the casting process.

It has to be mentioned that steps 512 and 514 may intertwine at the feeding end and the casting end, one being in a holding position while the other in a delivering position and vice-versa, to perform a relatively continuous casting process.

Step 516 comprises moving the tilting table down to put down the crucible, ready for pick up.

Step 518 comprises releasing the crucible from the grip of the fork arms and lock arms. After the release of the crucible, the crucible is ready to be picked up.

Step 520 comprises guiding the truck to pick up the crucible, and thereby freeing the delivery area for another crucible.

Step 522 illustrates the steps performed upon detection of problematic conditions. Whenever a problem arises during the steps 508, 510, 512, and 514, the system is adapted to initiate a safe condition through the initiation of steps 516 and 518. A safe condition is defined as when the crucible is on the tilting table in its support portion. Accordingly, whenever a problem arises, the crucible(s) on the tilting table(s) is or are tilted back to the vertical (wherein no pouring of molten metal out of the crucible can occur) and moved down on the ground.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A system for feeding molten metal to a receiving component, the system comprising:

a feeding component comprising a container and a support portion having legs capable of supporting the feeding component in an elevated and stable position above the ground, the feeding component providing the molten metal;

a launder circuit having an upstream end and a downstream end and a flow path fluidly connecting the upstream end to the downstream end, wherein the feeding component feeds the launder circuit with molten metal at the upstream end and the launder circuit feeds molten metal to the receiving component at the downstream end;

a feed tilting mechanism located at the upstream end for tilting the feeding component between a holding angle for holding molten metal in the feeding component and a feeding angle for feeding molten metal to the launder circuit;

a feeding scale for measuring weight of molten metal contained in the feeding component and generating weight signals indicative of a measured weight of molten metal in the feeding component; and a controller operatively connected to the feed tilting mechanism and to the feeding scale for controlling a feeding of molten metal to the launder circuit based on the weight signals received from the feeding scale, wherein the feed tilting mechanism comprises a table body and a fork-like structure, the fork-like structure comprises a first fork arm and a second fork arm opposite the first fork arm, which, during operation, grabs and lifts simultaneously both the container and the support portion, wherein the table body, the first fork arm and the second fork arm define a semi-enclosed perimeter comprising a passage allowing horizontal entrance of the feeding component in the semi-enclosed perimeter.

2. The system of claim 1, wherein the system further comprises:

a pouring launder for containing molten metal along the flow path;

a pouring launder scale for measuring weight of molten metal contained in the pouring launder and generating weight signals indicative of a measured weight of molten metal in the pouring launder; and a launder tilting mechanism for controlling operating positions of the pouring launder, wherein the operating positions comprise a holding position wherein molten metal is held in the pouring launder and a feeding position wherein molten metal is fed downstream out of the pouring launder;

wherein the controller is connected operatively to the launder tilting mechanism to control operating positions of the launder tilting mechanism based on weight signals from the pouring launder scale.

3. The system of claim 2, wherein the launder tilting mechanism comprises a hydraulic cylinder for tilting the pouring launder between a holding position in which the pouring launder is in the holding position and a feeding position in which the pouring launder is in the feeding position.

4. The system of claim 2, wherein the pouring launder comprises a pouring spout fluidly connecting the flow path with the receiving component.

5. The system of claim 4, wherein the pouring launder comprises a lug extending inwardly in the pouring spout, wherein the lug alters flow of molten metal in the pouring spout.

6. The system of claim 1, wherein the launder circuit comprises inlet channels and an outlet channel, wherein each one of the inlet channels is fluidly connected to the outlet channel.

7. The system of claim 1, wherein the system comprises the receiving component which comprises a sow mould.

8. The system of claim 1, wherein the system comprises the feeding component which comprises a crucible assembly.

9. The system of claim 1, wherein the molten metal is provided by a plurality of feeding components and wherein the feed tilting mechanism comprises a plurality of feed tilting mechanisms, each one of the feed tilting mechanisms is associated to one of the plurality of feeding components, and wherein the controller coordinates handling of each one of the plurality of feed tilting mechanisms for controlling a feeding of molten metal to the launder circuit.

10. A combination comprising:

a crucible assembly comprising a container and a support portion having legs capable of supporting the container in an elevated and stable position above the ground, the container containing molten metal; and a tilting table mounted to a structure fluidly connecting the tilting table to a sow carrousel, wherein the tilting table is adapted to receive the crucible assembly, the tilting table comprising:

an L-shaped body defining a vertical portion and a horizontal portion;

a pivot axis along the vertical portion, the pivot axis about which the L-shaped body is adapted to be mounted to the structure;

a feed tilting mechanism for tilting controllingly the L-shape body about the pivot axis; and a fork-like structure along the horizontal portion, the fork-like structure comprises a first fork arm and a second fork arm, wherein the first fork arm and the second fork arm respectively comprise lock arms which, during operation, handle and hold both the container and the support portion of the crucible assembly, wherein the tilting table is adapted when rotating about the pivot axis to pour the molten metal from the crucible assembly onto the structure so that the molten metal flows into the sow carrousel.

11. The combination of claim 10, further comprising hydraulic cylinders and wherein at least one of the first fork arm and the second fork arm is mobile under control of the hydraulic cylinder.

12. The combination of claim 10, further comprising:

a feeding scale for measuring weight of molten metal contained in the crucible assembly and generating weight signals indicative of a measured weight of molten metal in the crucible assembly; and a controller operatively connected to the feed tilting mechanism and to the feeding scale for controlling a feeding of molten metal to a launder circuit based on the weight signals received from the feeding scale.

13. A combination comprising:

a crucible assembly comprising a container and a support portion having legs capable of supporting the container in an elevated and stable position above the ground, the container containing molten metal; and a feed tilting mechanism for tilting the crucible assembly between a holding angle for holding molten metal in the container and a feeding angle for feeding molten metal to a launder circuit, wherein the feed tilting mechanism comprises fork-like structure comprising a first fork arm and a second fork arm opposite the first fork arm, which, during operation, handle and hold both the container and the support portion of the crucible assembly.

14. The combination of claim 13, wherein the feed tilting mechanism further comprising hydraulic cylinders and wherein at least one of the first fork arm and the second fork arm is mobile under control of the hydraulic cylinders.

15. The combination of claim 13, wherein the first fork arm and the second fork arm respectively comprise lock arms which lock the crucible assembly in place between the first fork arm and the second fork arm.

16. The combination of claim 15, wherein the feed tilting mechanism further comprises a pressure detector mounted on each of the lock arms.

17. The combination of claim 16, further comprising:

a feeding scale for measuring weight of molten metal contained in the crucible assembly and generating weight signals indicative of a measured weight of molten metal in the container; and a controller operatively connected to the feed tilting mechanism and to the feeding scale for controlling a feeding of molten metal to the launder circuit based on the weight signals received from the feeding scale.

18. The combination of claim 17, wherein the pressure detector are is connected to the controller.

* * * * *